US009640880B2

(12) United States Patent
Tran et al.

(10) Patent No.: US 9,640,880 B2
(45) Date of Patent: May 2, 2017

(54) CABLE CONNECTOR

(71) Applicant: Intel Corporation, Santa Clara, CA (US)

(72) Inventors: Donald T. Tran, Phoenix, AZ (US); Jeffrey Lee, Chandler, AZ (US); Gaurav Chawla, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 14/651,820

(22) PCT Filed: Jul. 1, 2014

(86) PCT No.: PCT/US2014/045116
§ 371 (c)(1),
(2) Date: Jun. 12, 2015

(87) PCT Pub. No.: WO2016/003448
PCT Pub. Date: Jan. 7, 2016

(65) Prior Publication Data
US 2016/0276759 A1 Sep. 22, 2016

(51) Int. Cl.
*H01R 12/53* (2011.01)
*H01R 9/03* (2006.01)
(Continued)

(52) U.S. Cl.
CPC ..... *H01R 12/53* (2013.01); *H01R 9/035* (2013.01); *H01R 13/6592* (2013.01);
(Continued)

(58) Field of Classification Search
CPC . H01R 12/53; H01R 13/6592; H01R 13/6593
(Continued)

(56) References Cited

U.S. PATENT DOCUMENTS 4,824,383 A * 4/1989 Lemke ..... H01R 24/60 439/108
5,328,380 A 7/1994 Carney
(Continued)

FOREIGN PATENT DOCUMENTS

CN 103650256 A 3/2014
JP 2001035567 A 2/2001
(Continued)

OTHER PUBLICATIONS

"International Application Serial No. PCT/US2014/045116, International Search Report mailed Feb. 27, 2015", 3 pgs.
(Continued)

*Primary Examiner* — Abdullah Riyami
*Assistant Examiner* — Harshad Patel
(74) *Attorney, Agent, or Firm* — Schwegman Lundberg & Woessner, P.A.

(57) ABSTRACT

A cable connector that includes a substrate having a plurality of conductive pads and at least one grounding pad. The cable connector further includes twin axial cable that includes a first conductor and second conductor, a first insulator that surrounds the first conductor, and a second insulator that surrounds the second conductor. The twin axial cable further includes a ground shield that surrounds the first and second insulator. The first conductor is electrically connected to one conductive pad and the second conductor is electrically connected to another of the conductive pads. The ground shield is electrically connected to the grounding pad. A shielding structure is mounted to the substrate and is electrically connected to the grounding pad. The shielding structure includes a cap and a plurality of sidewalls extending from the cap to the substrate. The twin axial cable is positioned between the side walls.

18 Claims, 13 Drawing Sheets

(51) Int. Cl.
*H01R 13/6592* (2011.01)
*H01R 13/6593* (2011.01)
*H01R 13/6594* (2011.01)

(52) U.S. Cl.
CPC ..... *H01R 13/6593* (2013.01); *H01R 13/6594* (2013.01); *H01R 9/038* (2013.01)

(58) Field of Classification Search
USPC ..... 174/75 C, 78, 88 R, 84 R, 261; 439/63, 439/607.13, 607.35, 607.36, 607.37, 439/607.46, 607.55, 607.34, 607.05
See application file for complete search history.

(56) References Cited

U.S. PATENT DOCUMENTS 5,417,590 A * 5/1995 Dechelette ..... H01R 13/64 439/607.48
6,336,827 B1 * 1/2002 Akama ..... H01R 12/62 174/261
6,380,485 B1 * 4/2002 Beaman ..... H01R 9/035 174/88 R
7,192,301 B2 * 3/2007 Kuroda ..... H01R 13/6592 439/497
7,497,724 B1 * 3/2009 Fong ..... H01R 4/023 439/497
8,298,009 B2 * 10/2012 Elkhatib ..... H01R 12/594 439/581
8,758,051 B2 * 6/2014 Nonen ..... H01R 4/023 174/88 R
8,840,432 B2 * 9/2014 Alden, III ..... H01R 13/648 439/607.35
2010/0294530 A1 11/2010 Atkinson et al.
2012/0325554 A1 * 12/2012 Aizawa ..... H01R 12/596 174/84 R
2013/0017716 A1 1/2013 Elkhatib et al.
2013/0188325 A1 7/2013 Garman et al.
2014/0170897 A1 * 6/2014 Nonen ..... H01R 13/5829 439/467

FOREIGN PATENT DOCUMENTS

JP 2009076375 A 4/2009
JP 2011028903 A 2/2011
JP 2016529664 A 9/2016
TW 201242199 A 10/2012
TW 201251207 A 12/2012
TW 201308361 A 2/2013
TW 201351811 A 12/2013
TW 201611437 A 3/2016
WO WO-2013006592 A2 1/2013
WO WO-2016003448 A1 1/2016

OTHER PUBLICATIONS

"International Application Serial No. PCT/US2014/045116, Written Opinion mailed Feb. 27, 2015", 8 pgs.
"European Application Serial No. 14870660.9, Extended European Search Report mailed Oct. 5, 2016", 6 pgs.
"Japanese Application Serial No. 2016-531619, Office Action mailed Oct. 4, 2016", W/ English Translation. 11 pgs.
"Taiwanese Application Serial No. 104120158, Office Action mailed Sep. 21, 2016", W/ English search report, 7 pgs.

* cited by examiner

CABLE CONNECTOR

This application is a U.S. National Stage Application under 35 U.S.C. 371 from International Application No. PCT/US2014/045116, filed Jul. 1, 2014, which is hereby incorporated by reference in its entirety.

TECHNICAL FIELD

Embodiments described herein generally relate to a cable connector.

BACKGROUND

Most conventional high speed cable uses an internet paddle card (also referred to as interposer) to make a transition from cable to connector. The paddle card is commonly a PCB substrate that has pads on one end to accommodate cable soldering. The other end of the paddle card has electrical terminals, such as gold-finger or contacts, for mating with another connector (e.g., a QFSP connector, SAS connector, CFP connector).

Most conventional cable connectors are satisfactory for data rates less than 15 Gbps, but are unsuitable for use to transmit data at anything greater than 15 Gbps. FIG. 1 shows a perspective view of a prior art cable connector 1 and FIG. 2 is a side view of the cable connector 1 shown in FIG. 1. FIG. 3 is section view of the cable connector shown FIG. 1 taken along line 3-3.

The prior art cable connector 1 includes cables 2A, 2B, 2C that are soldered onto a paddle card 3, which could be either PCB or FCB substrate. The ends 4A, 4B, 4C of the cables 2A, 2B, 2C are stripped-off to expose the conductors 5A, 5B, 5C, insulators 6A, 6B, 6C, and ground shields 7A, 7B, 7C. The conductors 5A, 5B, 5C are soldered onto the signal pads 8A, 8B, 8C, and the ground shields 7A, 7B, 7C are soldered onto a ground pad 9.

It should be noted that although only three cables 2A, 2B, 2C are shown in FIGS. 1-3, any number and type of cables are typically included in a prior art cable connector 1. As an example, the total number of cables may be an even number of cables such that one half of the cables are transmitting cables and the other half of the cables is receiving cables.

One of the drawbacks with the prior art cable connector 1 is that there are sections S between the ground shields 7A, 7B, 7C and the conductors 5A, 5B, 5C that are unshielded. The impedance of the unshielded sections S (see FIG. 2) is not well-controlled which may result in an unwanted increase in impedance.

This impedance discontinuity may significantly increase return loss and insertion loss. Return loss should be minimized through impedance matching to prevent signal reflections, and insertion loss should also be minimized to ensure proper signal transmission through the cable-to-board interface. Ideally, this interface should appear electrically transparent and permit signals to pass through unaltered. A properly designed ground structure may provide the necessary impedance tuning to lower return and insertion loss.

Another drawback with the prior art cable connector 1 is the lack of shielding between adjacent cables 2A, 2B, 2C. Without proper ground shielding, signaling from one differential pair may couple into an adjacent pair in the form of crosstalk, which can be very detrimental to signal integrity. Ideally, signaling from each differential pair should be completely isolated from its neighboring pair. The aforementioned ground structure design proposal can serve a second purpose in minimizing crosstalk as well.

DESCRIPTION OF EMBODIMENTS

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Orientation terminology, such as "horizontal," as used in this application is defined with respect to a plane parallel to the conventional plane or surface of a wafer or substrate, regardless of the orientation of the wafer or substrate. The term "vertical" refers to a direction perpendicular to the horizontal as defined above. Prepositions, such as "on," "side" (as in "sidewall"), "higher," "lower," "over," and "under" are defined with respect to the conventional plane or surface being on the top surface of the wafer or substrate, regardless of the orientation of the wafer or substrate.

The example cable connectors described herein may reduce the effects of unshielded wire portions that exist in conventional cable connectors. The example cable connectors described herein include a shielding structure above a cable solder junction area.

Figure 1:
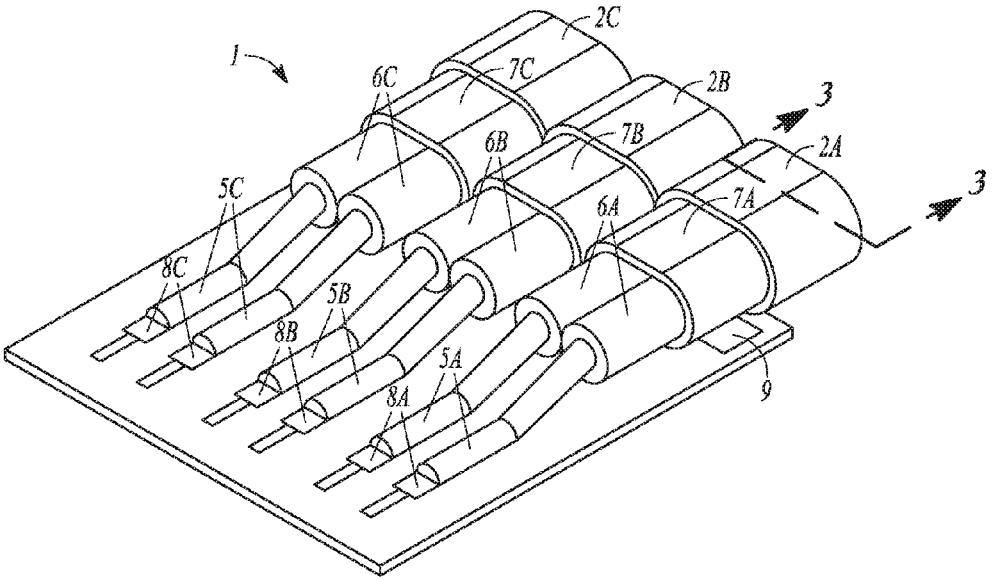
FIG. 1 (PRIOR ART)
FIG. 1 shows a perspective view of a prior art cable connector.
Figure 2:
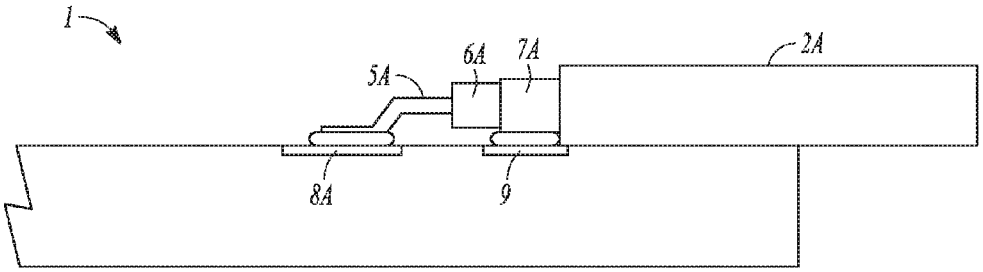
FIG. 2 (PRIOR ART)
FIG. 2 is a side view of the cable connector shown in FIG. 1.
Figure 3:
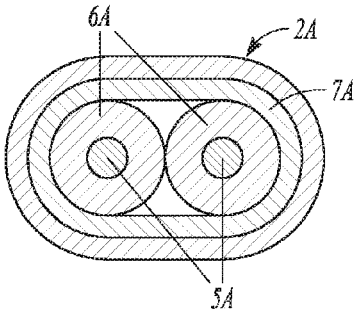
FIG. 3 (PRIOR ART)
FIG. 3 is section view of the cable connector shown FIG. 1 taken along line 3-3.
Figure 4:
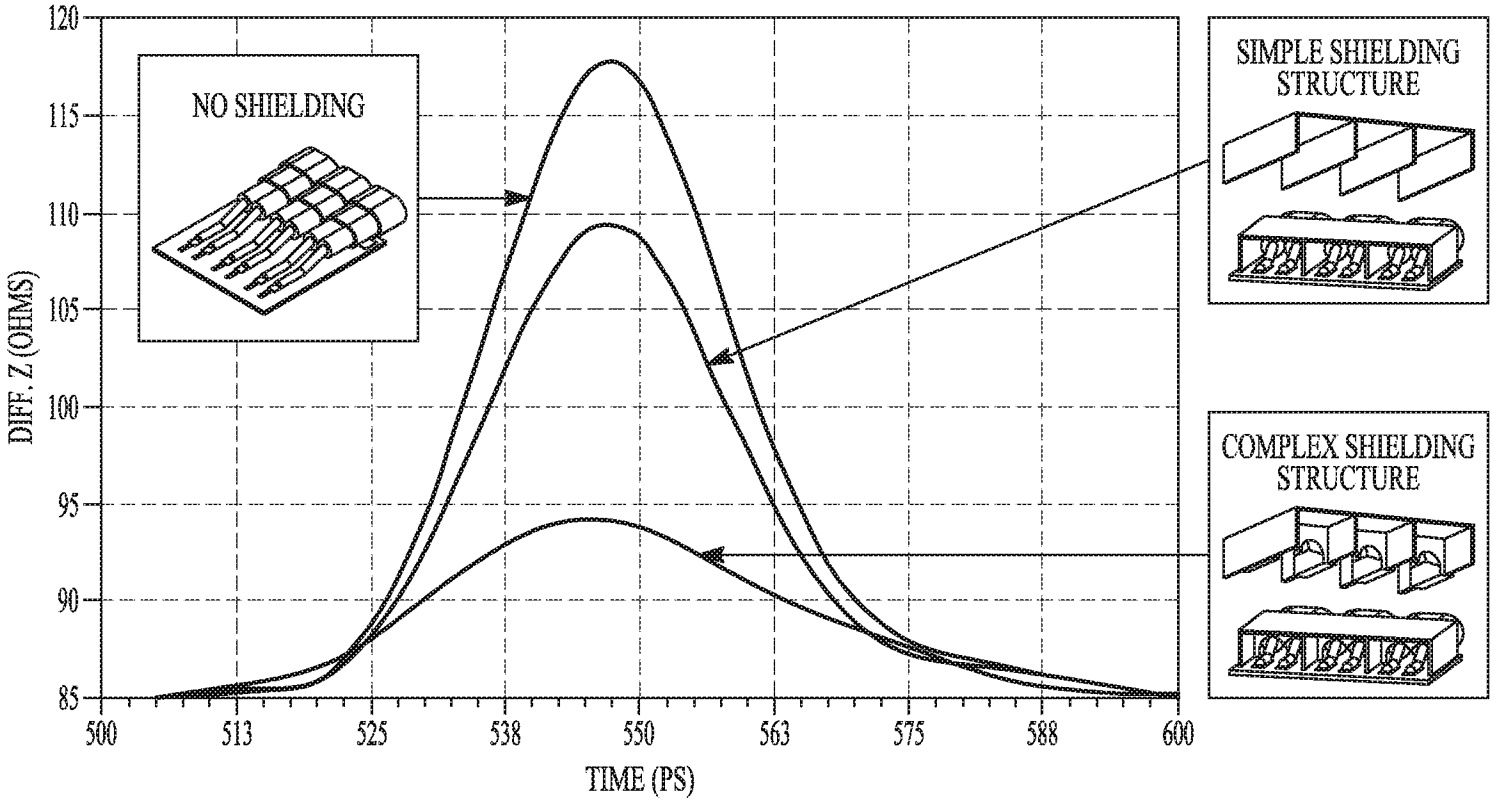
FIG. 4 shows the effect of including a shielding structure in the example cable connectors described herein.

FIG. 4 shows the effect of including a shielding structure in the example cable connectors described herein. FIG. 4 illustrates a simple shielding structure and a more complex shielding structure.

The impedance upswing may be reduced from 118 to 109 Ohms using the simple shielding structure, and the impedance upswing may be reduced from 118 to 94 Ohms using the complex shielding structure. It should be noted that 94 Ohms is much closer to the 85 Ohm ideal state.

Figure 5A:
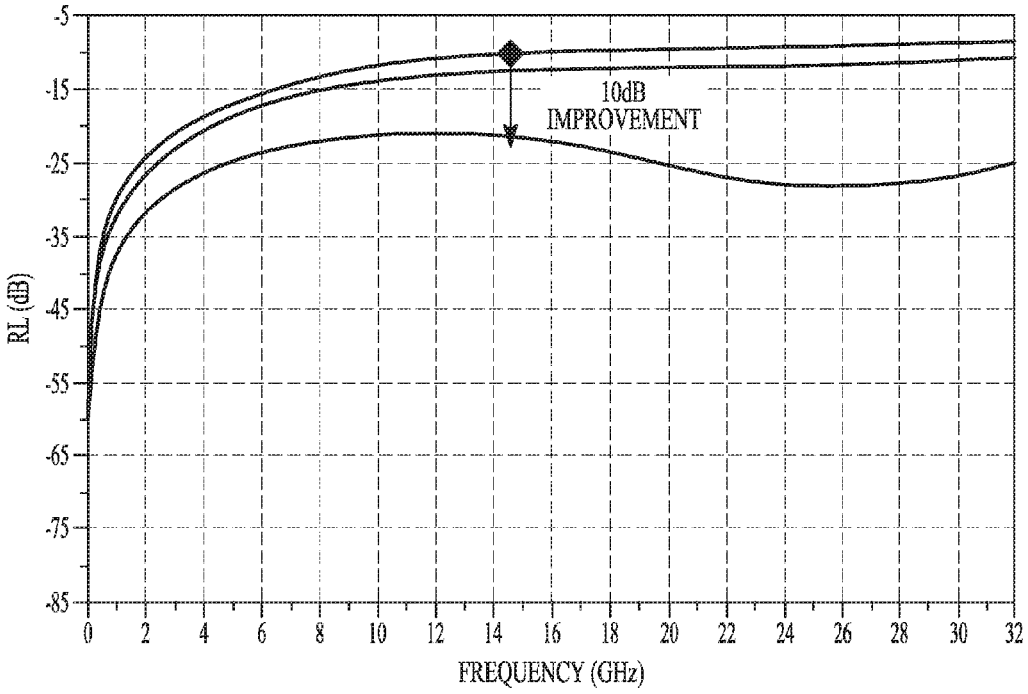
FIG. 5A shows the improved return loss for some of the example cable connectors described herein.

FIG. 5A shows the improved return loss for some of the example cable connectors described herein. The return loss (RL) improved by −10 dB.

Figure 5B:
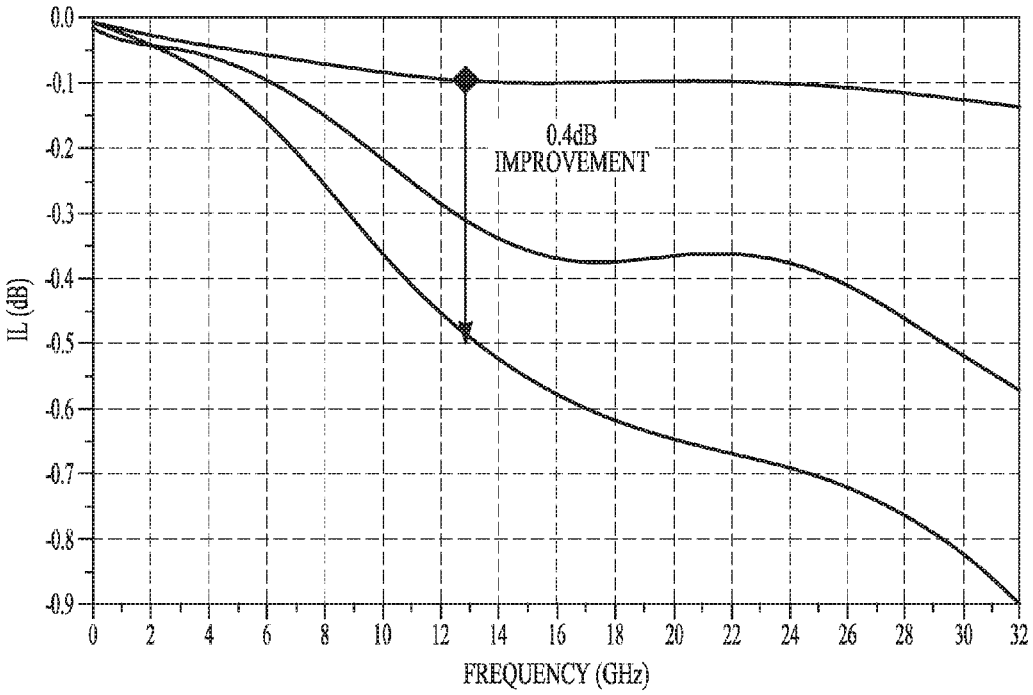
FIG. 5B shows the improved insertion loss for some of the example cable connectors described herein.

FIG. 5B shows the improved insertion loss for some of the example cable connectors described herein. The insertion loss (IL) improved from −0.5 to −0.1 dB.

Figure 5C:
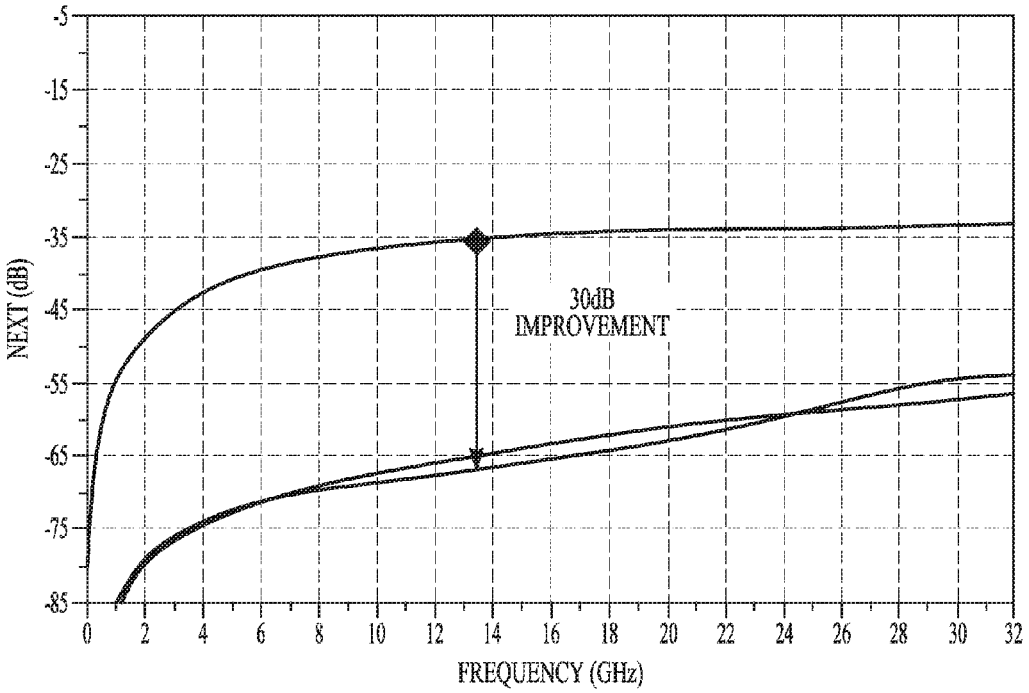
FIG. 5C shows the improved near-end crosstalk (NEXT) for some of the example cable connectors described herein.

FIG. 5C shows the improved near-end crosstalk (NEXT) for some of the example cable connectors described herein. The near-end crosstalk (NEXT) improved by −30 dB.

Figure 5D:
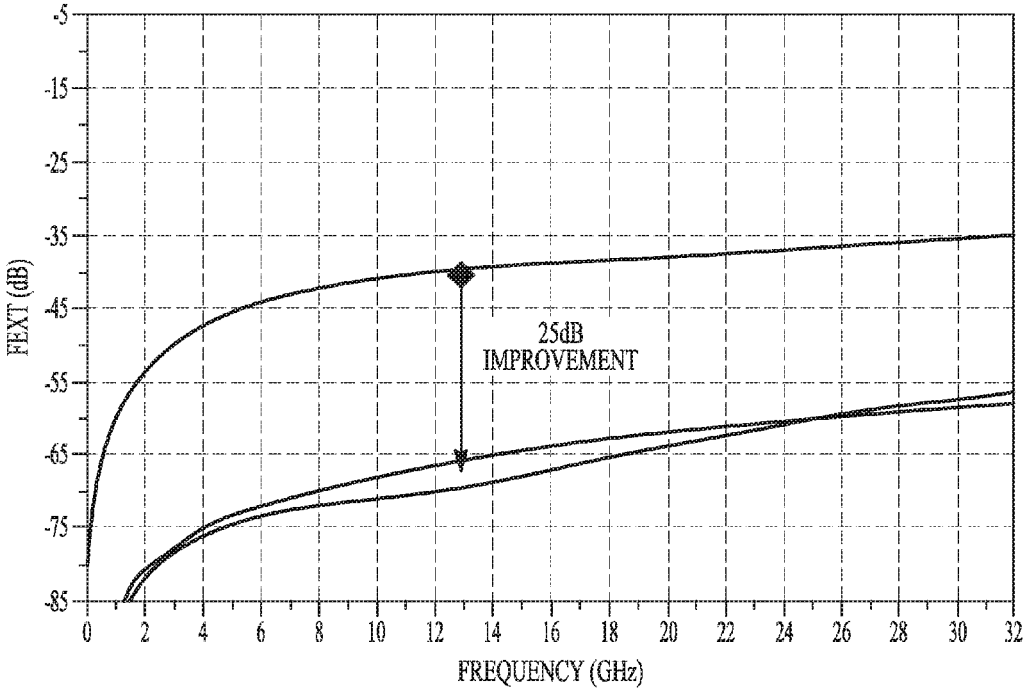
FIG. 5D shows the improved far-end crosstalk (FEXT) for some of the example cable connectors described herein.

FIG. 5D shows the improved far-end crosstalk (FEXT) for some of the example cable connectors described herein. The far-end crosstalk (FEXT) improved by −25 dB.

Conventional cable connectors typically do include any shielding at the solder junction because such shielding may not be necessary to operate at slower speed (<15 Gbps). The shielding structure in the example cable connectors described herein may permit operation at higher high speeds (>25 Gbps).

Figure 6:
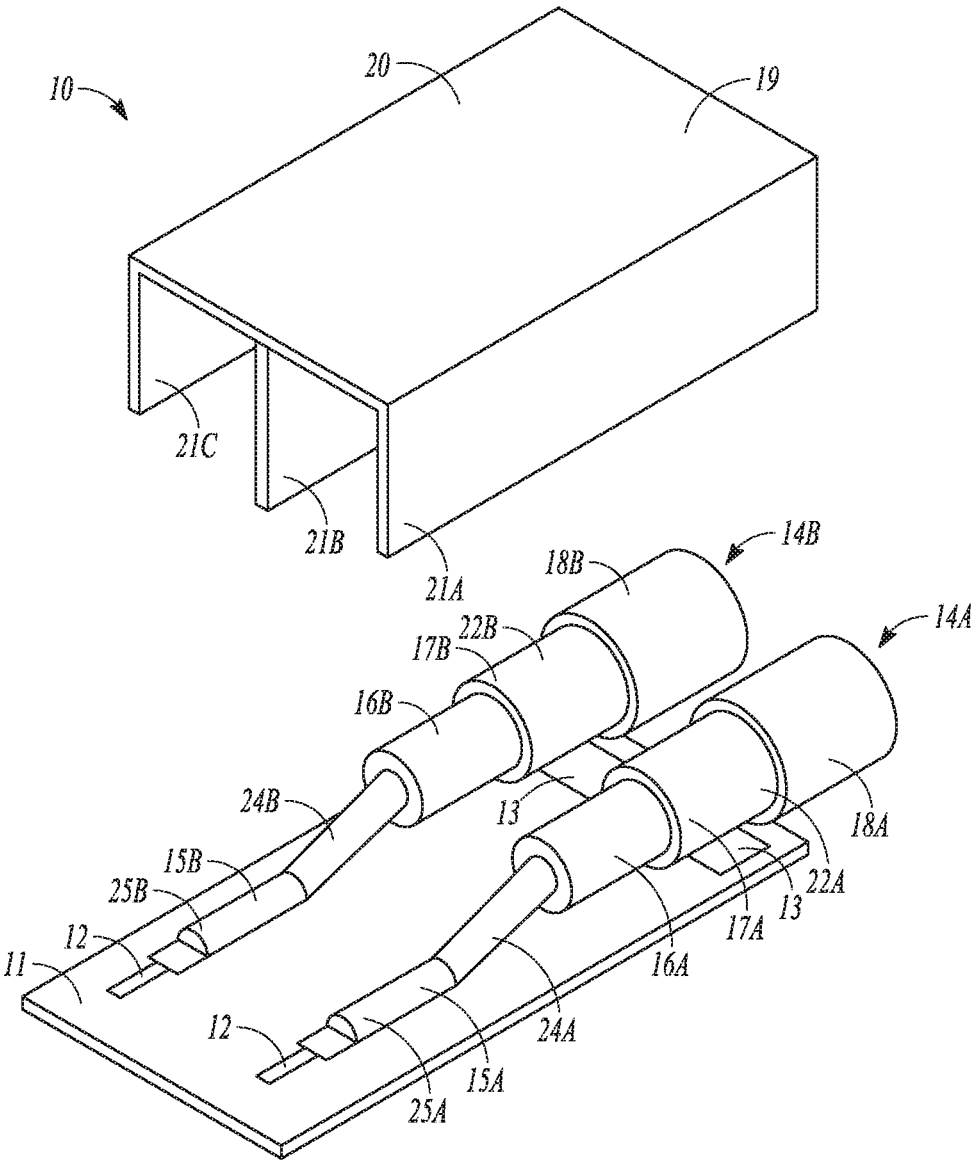
FIG. 6 shows an exploded perspective view of an example cable connector.
Figure 7:
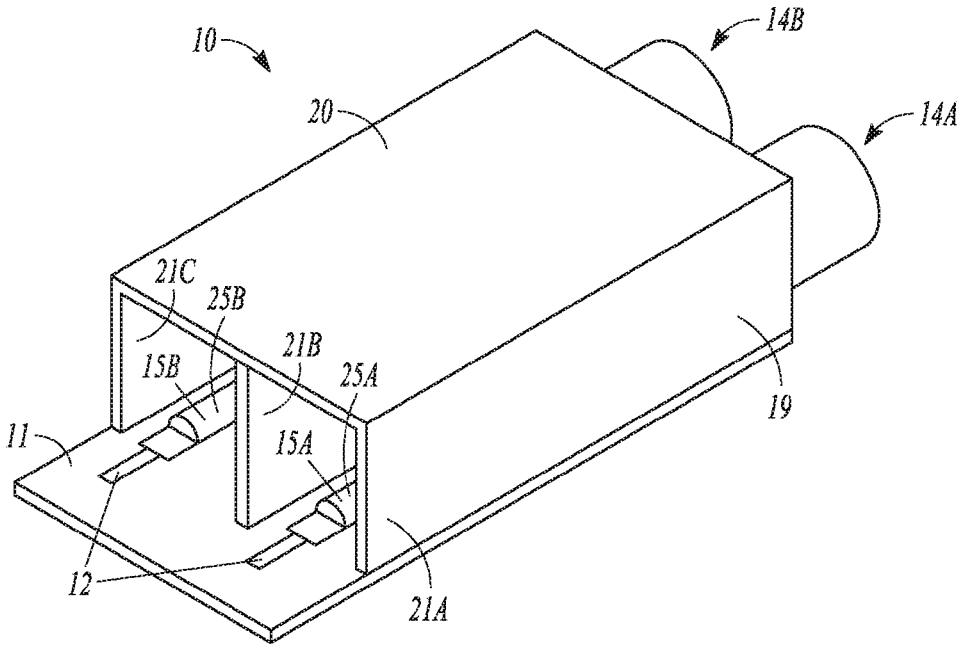
FIG. 7 shows an assembled perspective view of the example cable connector illustrated in FIG. 6.

FIG. 6 shows an exploded perspective view of an example cable connector 10. FIG. 7 shows an assembled perspective view of the example cable connector 10 illustrated in FIG. 6.

The cable connector 10 includes a substrate 11 having a plurality of conductive pads 12 and at least one grounding pad 13 (FIG. 6). The cable connector 10 further includes a transmitting cable 14A that includes a conductor 15A, an insulator 16A surrounding the conductor 14A and a ground shield 17A surrounding the insulator 16A. The conductor 15A is electrically connected to one of the conductive pads 12 and the grounding shield 17A is electrically connected to the grounding pad 13. An outer jacket 18A covers the grounding shield 17A.

The cable connector 10 further includes a receiving cable 14B that includes a conductor 15B, an insulator 16B surrounding the conductor 15B and a ground shield 17B surrounding the insulator. The conductor 15B is electrically connected to one of the conductive pads and the grounding shield 17B is electrically connected to the grounding pad 13. An outer jacket 18B covers the grounding shield 17B.

The cable connector 10 further includes a shielding structure 19 that is mounted to the substrate 11 and is electrically connected to the grounding pad 13. The shielding structure 19 includes a cap 20 and a plurality of sidewalls 21A, 21B, 21C extending from the cap 20 to the substrate 11. Each of the transmitting and receiving cables 14A, 14B is positioned between a different pair of side walls 21A, 21B, 21C.

Figure 8:
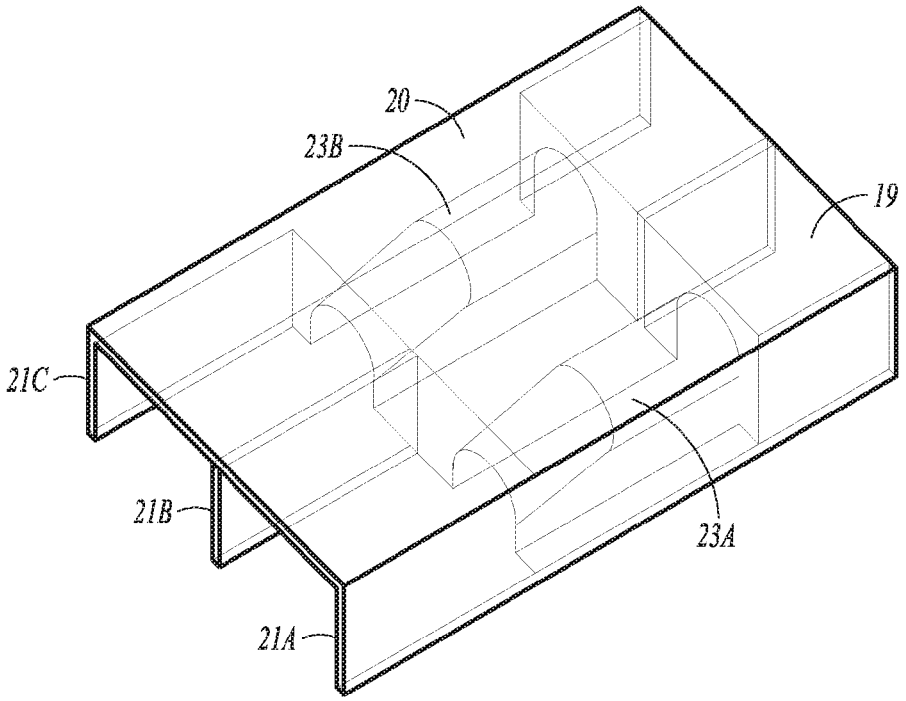
FIG. 8 shows a perspective view of an alternative shielding structure that may be used in the example cable connector illustrated in FIGS. 6 and 7.

FIG. 8 shows a perspective view of an alternative shielding structure that may be used in the example cable connector illustrated in FIGS. 6 and 7. The insulators 16A, 16B of the transmitting and receiving cables 14A, 14B may each include a respective section 22A, 22B (see FIG. 6) that is partially exposed from the respective grounding shields 17A, 17B. The shielding structure 19 includes a pair of tunnel-shaped covers 23A, 23B. Each tunnel-shaped cover 23A, 23B extends between a different pair of side walls 21A, 21B, 21C and covers the exposed section 22A, 22B of one of the insulators 16A, 16B.

As shown in FIG. 6, the conductors 15A, 15B of the transmitting and receiving cables 14A, 14B each include a first portion 24A, 24B and a second portion 25A, 25B that are partially exposed from the respective insulators 16A, 16B. The second portion 25A, 25B of each conductor 15A, 15B is electrically connected to a different one of the conductive pads 12. The tunnel-shaped covers 23A, 23B of the shielding structure 19 cover the exposed first portion 24A, 24B of each conductor 15A, 15B without covering the exposed second portion 25A, 25B of each conductor 15A, 15B.

In some forms of the cable connector 10, the shielding structure 19 may be formed of plastic and each tunnel-shaped cover 23A, 23B may be covered with an electrically conductive material. In other forms of the cable connector 10, the entire shielding structure 19 may be covered with an electrically conductive material or be formed of a conductive material itself.

It should be noted that the electrically conductive material may be attached to the support structure 19 by any bonding method that is known now or discovered in the future. As an example, the shielding structure 19 may be electrically connected to a ground pad 13 on the corresponding substrate 11 by any soldering technique.

The manner in which the electrically conductive material is bonded to the support structure 19 (or portions of the support structure) will depend in part on cost, manufacturing considerations and the functionality associated with fabricating the cable connector 10 (among other factors). In addition, the type of material that is used for the electrically conductive material and the support structure 19 will depend in part on cost, manufacturing considerations and the functionality associated with fabricating the cable connector 10 (among other factors).

In some forms, a different melting point temperature solder type may be used to ensure that soldering the shielding structure 19 to a substrate 11 will not affect the conductor solder joint quality. As other examples, the shielding structure 19 may be electrically connected to the ground pad 13 by paste-printing, through-hole mounting or by using electrical conductive glue.

Figure 9:
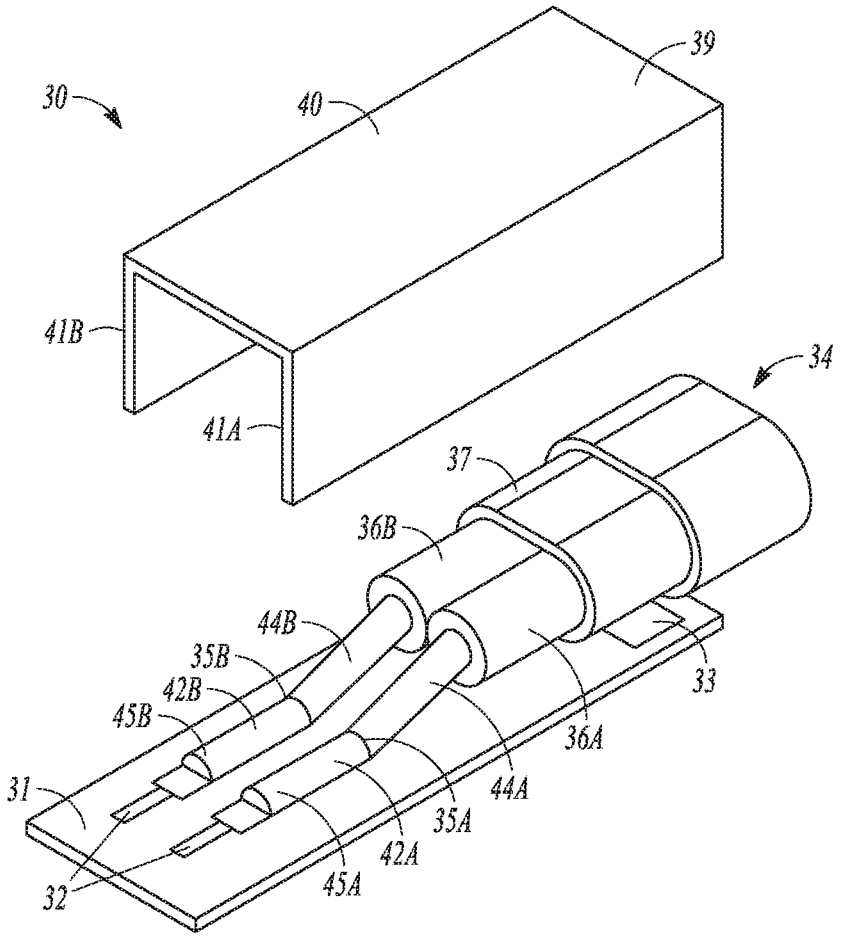
FIG. 9 shows an exploded perspective view of another example cable connector.
Figure 10:
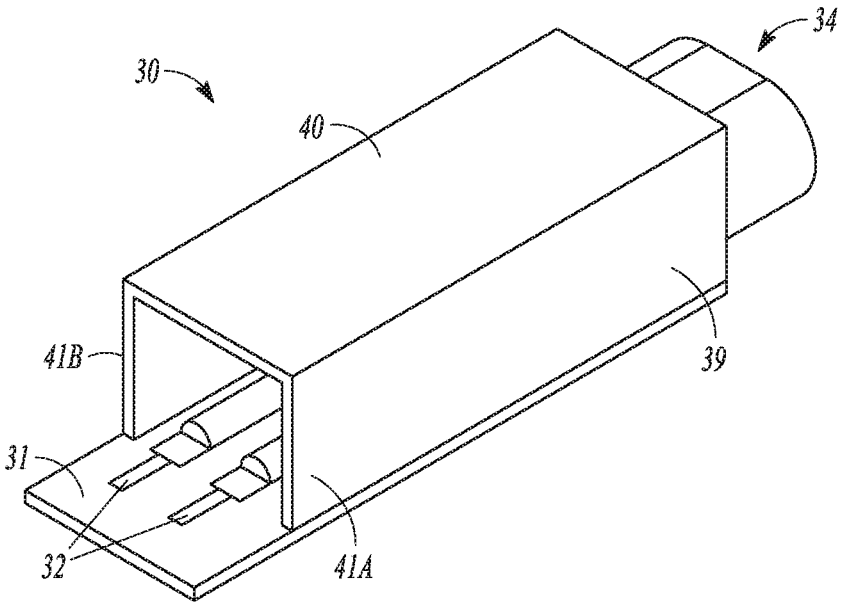
FIG. 10 shows an assembled perspective view of the example cable connector illustrated in FIG. 9.

FIG. 9 shows an exploded perspective view of another example cable connector 30. FIG. 10 shows an assembled perspective view of the example cable connector 30 illustrated in FIG. 9.

The cable connector 30 includes a substrate 31 having a plurality of conductive pads 32 and at least one grounding pad 33 (FIG. 9). The cable connector 30 further includes twin axial cable 34 that includes a first conductor 35A and second conductor 35B.

The twin axial cable 34 further includes a first insulator 36A that surrounds the first conductor 35A and a second insulator 36B that surrounds the second conductor 35B. The twin axial cable 34 further includes a ground shield 37 that surrounds the first insulator 36A and the second insulator 36B. It should be noted that forms of the cable connector 30 are contemplated where the first insulator 36A and the second insulator 36B are replaced by a single insulator that covers and segregates the first and second conductors 35A, 35B.

The first conductor 35A is electrically connected to one of the conductive pads 32 and the second conductor 35A is electrically connected to another of the conductive pads 32. The grounding shield 37 is electrically connected to the grounding pad 33.

The cable connector 30 further includes a shielding structure 39 that is mounted to the substrate 31 and is electrically connected to the grounding pad 33. The shielding structure 39 includes a cap 40 and a plurality of sidewalls 41A, 41B extending from the cap 40 to the substrate 31. The twin axial cable 34 is positioned between the side walls 41A, 41B.

Figure 11:
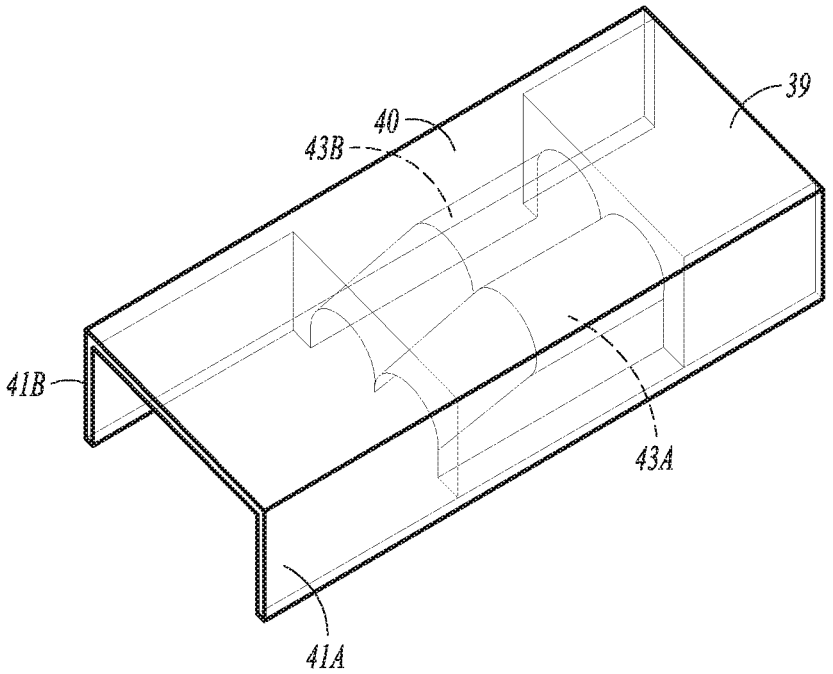
FIG. 11 shows a perspective view of an alternative shielding structure that may be used in the example cable connector illustrated in FIGS. 9 and 10.

FIG. 11 shows a perspective view of an alternative shielding structure that may be used in the example cable connector illustrated in FIGS. 9 and 10. The insulators 36A, 36B of the twin axial cable 34 may each include a respective section 42A, 42B (see FIG. 9) that is partially exposed from the respective grounding shield 37. The shielding structure 39 includes tunnel-shaped covers 43A, 43B. The tunnel-shaped covers 43A, 43B extend between the side walls 41A, 41B and cover the exposed sections 42A, 42B of the insulators 36A, 36B.

As shown in FIG. 9, the conductors 35A, 35B of the twin axial cable 34 each include a first portion 44A, 44B and a second portion 45A, 45B that are each partially exposed from the respective insulators 36A, 36B. The second portion 45A, 45B of each conductor 35A, 35B is electrically connected to a different one of the conductive pads 32. The tunnel-shaped covers 43A, 43B of the shielding structure 39 covers the exposed first portion 44A, 44B of each conductor 35A, 35B without covering the exposed second portion 45A, 45B of each conductor 35A, 35B.

In some forms of the cable connector 30, the support structure 39 may be formed of plastic and each tunnel-shaped cover 43A, 43B may be covered with an electrically conductive material. In other forms of the cable connector 30, the entire support structure 39 may be covered with an electrically conductive material, or formed of an electrically conductive material itself. It should be noted that the electrically conductive material may be attached to the support structure 39 by any bonding method that is known now or discovered in the future.

The manner in which the electrically conductive material is bonded to the support structure 39 (or portions of the support structure) will depend in part on cost, manufacturing considerations and the functionality associated with fabricating the cable connector 30 (among other factors). In addition, the type of material that is used for the electrically conductive material and the support structure 39 will depend in part on cost, manufacturing considerations and the functionality associated with fabricating the cable connector 30 (among other factors).

The shielding structure 39 may be electrically connected to a ground pad 33 on the corresponding substrate 31 by any soldering technique. In some forms, a different melting point temperature solder type may be used to ensure that soldering the shielding structure 39 to a substrate 31 will not affect the conductor solder joint quality. As other examples, the shielding structure 39 may be electrically connected to the ground pad 33 by paste-printing, through-hole mounting or by using electrical conductive glue.

Figure 12:
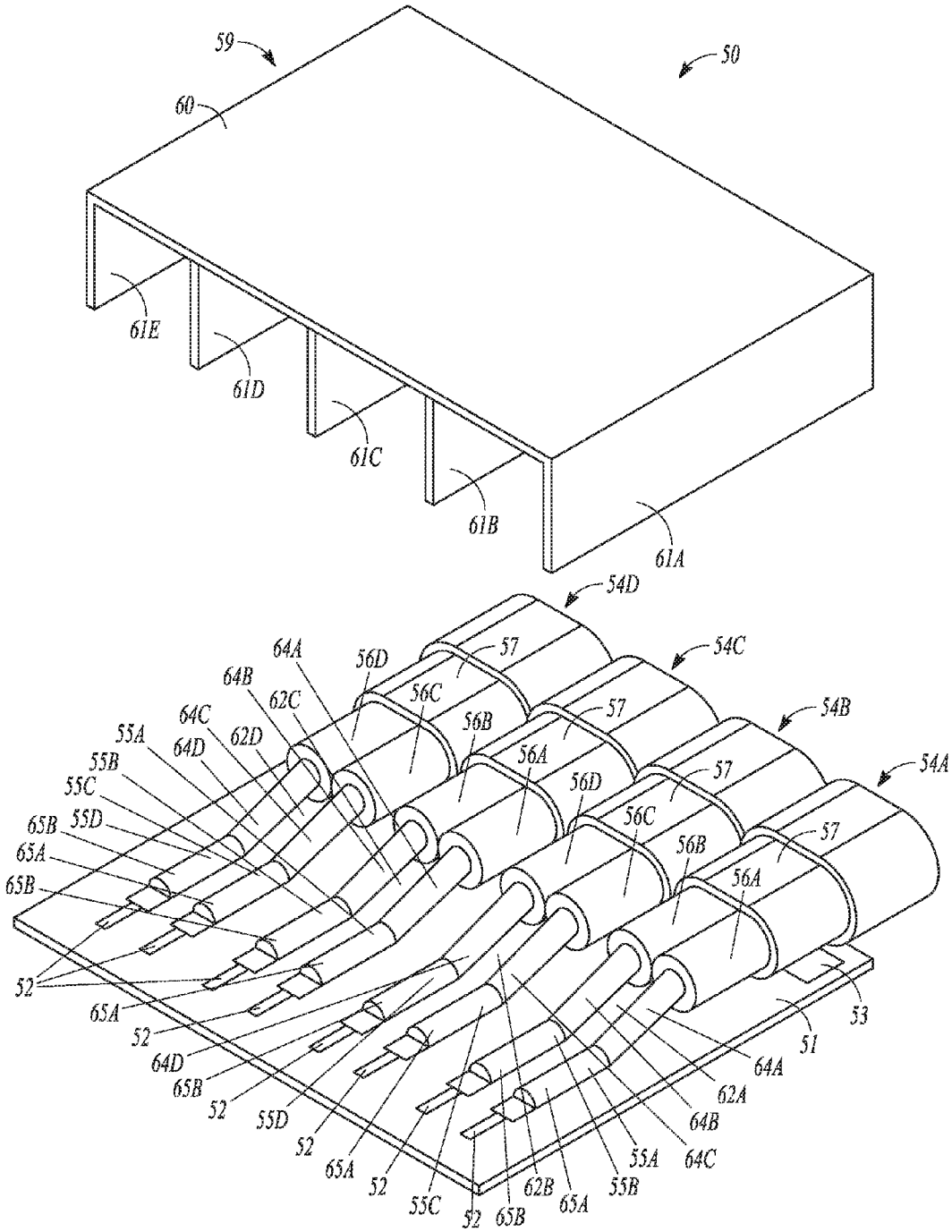
FIG. 12 shows an exploded perspective view of an example cable connector.
Figure 13:
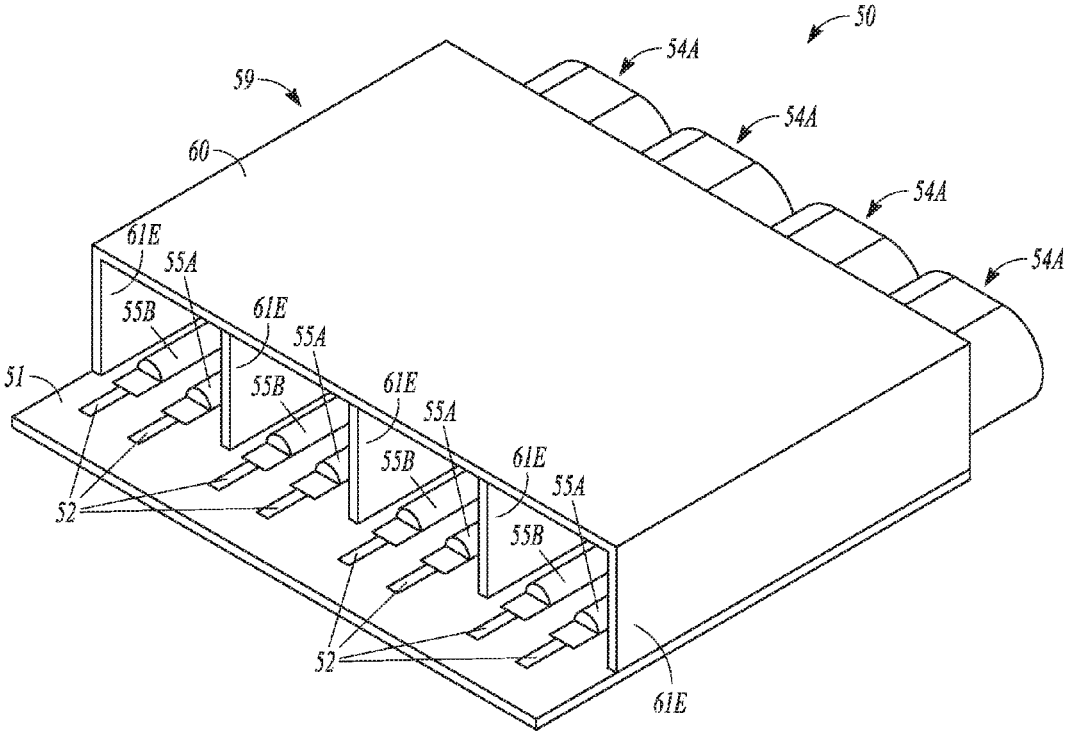
FIG. 13 shows an assembled perspective view of the example cable connector illustrated in FIG. 12.

FIG. 12 shows an exploded perspective view of another example cable connector 50. FIG. 13 shows an assembled perspective view of the example cable connector 50 illustrated in FIG. 12.

The cable connector 50 includes a substrate 51 having a plurality of conductive pads 52 and at least one grounding pad 53 (FIG. 12). The cable connector 50 further includes a plurality of twin transmitting axial cables 54A, 54C that each includes a first conductor 55A and second conductor 55B.

Each twin transmitting axial cable 54A, 54C further includes a first insulator 56A that surrounds the first conductor 55A and a second insulator 56B that surrounds the second conductor 55B. It should be noted that forms of the cable connector 50 are contemplated where the first insulator 56A and the second insulator 56B are replaced by a single insulator that covers and segregates the first and second conductors 55A, 55B. Each twin transmitting axial cable 54A, 54C further includes a respective ground shield 57 that surrounds a respective first and second insulator 56A, 56B.

The first conductors 55A are each electrically connected to a different one of the conductive pads 52 and the second conductors 55B are each electrically connected to other different conductive pads 52. The grounding shields 57 are each electrically connected to the grounding pad 53.

The cable connector 50 further includes a plurality of twin receiving axial cables 54B, 54D that each includes a first conductor 55C and second conductor 55D. Each twin receiving axial cable 54B, 54D further includes a first insulator 56C that surrounds the first conductor 55C and a second insulator 56D that surrounds the second conductor 55D.

It should be noted that forms of the cable connector 50 are contemplated where the first insulator 56C and the second insulator 56D are replaced by a single insulator that covers and segregates the first and second conductors 55C, 55D. Each twin receiving axial cable 54B, 54D further includes a respective ground shield 57 that surrounds a respective first and second insulator 56C, 56D.

The first conductors 55C are each electrically connected to a different one of the conductive pads 52 and the second conductors 55D are each electrically connected to other different conductive pads 52. The grounding shields 57 are each electrically connected to the grounding pad 53.

The cable connector 50 further includes a shielding structure 59 that is mounted to the substrate 51 and is electrically connected to the grounding pad 53. The shielding structure 59 includes a cap 60 and a plurality of sidewalls 61A, 61B, 61C, 61D, 61E extending from the cap 60 to the substrate 51.

As shown in FIG. 13, each twin transmitting axial cable 51A, 51B and each twin receiving axial cable 51C, 51D are positioned between a different pair of sidewalls 61A, 61B, 61C, 61D, 61E. In some example forms of the cable connector 50, each twin transmitting axial cable 51A, 51B is adjacent to at least one twin receiving axial cable 51C, 51D and each twin receiving axial cable 51C, 51D is adjacent to at least one twin transmitting axial cable 51A, 51B.

Figure 14:
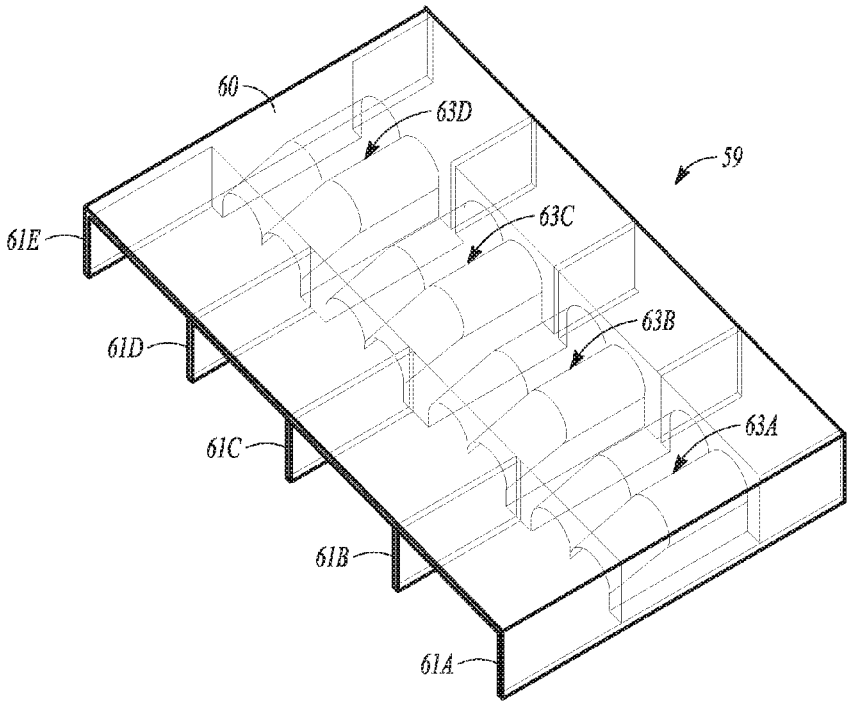
FIG. 14 shows a perspective view of an alternative shielding structure that may be used in the example cable connector illustrated in FIGS. 12 and 13.

FIG. 14 shows a perspective view of an alternative shielding structure 59 that may be used in the example cable connector 50 illustrated in FIGS. 12 and 13. The insulators 56A, 56B of the twin transmitting and receiving axial cables 54A, 54B, 54C, 54D may each include a respective section 62A, 62B, 62C, 62D (see FIG. 12) that is partially exposed from the respective grounding shields 57. The shielding structure 59 includes a plurality of covers 63A, 63B, 63C, 63D. Each of the covers 63A, 63B, 63C, 63D extends between a different pair of side walls 61A, 61B, 61C, 61D, 61E and covers the respective exposed sections 62A, 62B, 62C, 62D of one of the insulators 56A, 56B.

Each of the covers 63A, 63B, 63C, 63D may include a first tunnel-shaped segment that covers the respective exposed sections 62A, 62B, 62C, 62D of a corresponding first transmitting or receiving insulator 56A and a plurality of second tunnel-shaped segments that covers the respective exposed sections 62A, 62B, 62C, 62D of a corresponding second transmitting or receiving insulator 56B.

As shown in FIG. 12, the conductors 55A, 55B of each twin transmitting axial cable 54A, 54B and the conductors 55C, 55D of each receiving axial cable 54C, 54D include a first portion 64A, 64B and a second portion 65A, 65B that are each partially exposed from the respective insulators 56A, 56B. The second portion 65A, 65B of each conductor 55A, 55B is electrically connected to a different one of the conductive pads 52. The first and second tunnel-shaped segments of the shielding structure 59 cover the exposed first portions 64A, 64B of each conductor 55A, 55B, 55C, 55D without covering the exposed second portions 65A, 65B of each conductor 55A, 55B 55C, 55D.

Each of the first tunnel-shaped segments includes a horizontal piece that covers a respective first transmitting or first receiving insulator 56A and an angled piece that covers the exposed first portion 64A of the first transmitting or first receiving conductor 55A, 55C. In addition, each of the second tunnel-shaped segments includes a horizontal piece that covers a respective second transmitting or second receiving insulator 56B and an angled piece that covers the exposed first portion 64B of the respective second transmitting or second receiving conductor 55B, 55D.

In some forms of the cable connector 50, the support structure 59 may be formed of plastic and the cover 60 may be covered with an electrically conductive material. In other forms of the cable connector 50, the entire support structure 59 may be covered with an electrically conductive material, or formed of an electrically conductive material itself.

It should be noted that the electrically conductive material may be attached to the support structure 59 by any bonding method that is known now or discovered in the future. The manner in which the electrically conductive material is bonded to the support structure 59 (or portions of the support structure) will depend in part on cost, manufacturing considerations and the functionality associated with fabricating the cable connector 50 (among other factors). In addition, the type of material that is used for the electrically conductive material and the support structure 59 will depend in part on cost, manufacturing considerations and the functionality associated with fabricating the cable connector 50 (among other factors).

The shielding structure 59 may be electrically connected to a ground pad 53 on the corresponding substrate 51 by any soldering technique. In some forms, a different melting point temperature solder type may be used to ensure that soldering the shielding structure 59 to a substrate 51 will not affect the conductor solder joint quality. As other examples, the shielding structure 59 may be electrically connected to the ground pad 53 by paste-printing, through-hole mounting or by using electrical conductive glue.

Figure 15:
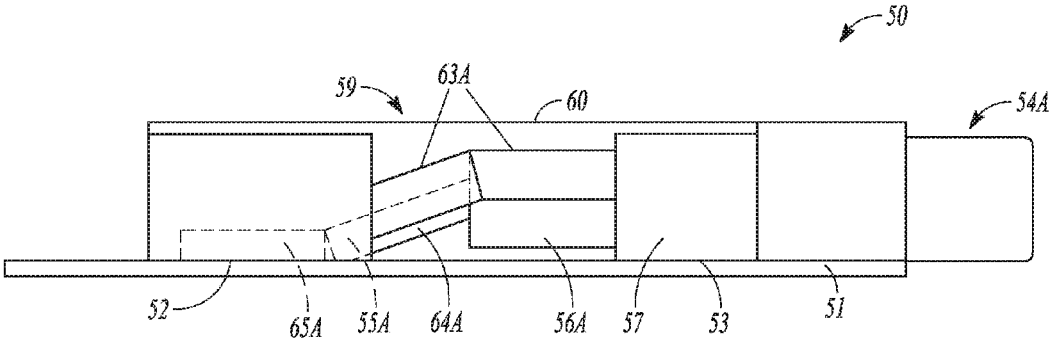
FIG. 15 shows a schematic side view of the example cable connector illustrated in FIG. 14.

FIG. 15 shows a schematic side view of the example cable connector 50 illustrated in FIG. 14. Describing the high speed electrical connector 50 in FIG. 15 from left to right, the high speed electrical connector 50 includes a hollow section 69 that may maximize the spacing between the exposed second portion 65A, 65B of each conductor 55A, 55B, 55C, 55D and the surrounding shielding structure 59.

Maximizing the spacing between the exposed second portion 65A, 65B of each conductor 55A, 55B, 55C, 55D and the surrounding shielding structure 59 may minimize the capacitance in this region and mitigate crosstalk between each twin transmitting axial cable 54A, 54C and each twin receiving axial cable 54B, 54D. In addition, when the side walls 61A, 61B, 61C, 61D, 61E are shielded, the side walls 61A, 61B, 61C, 61D, 61E may further mitigate crosstalk between each twin transmitting axial cable 54A, 54C and each twin receiving axial cable 54B, 54D.

Describing now to the right of the conductive pads 52, the signal-to-ground capacitance may be greatly reduced as each conductor 55A, 55B, 55C, 55D lifts away from a ground plane that is within the substrate 51. This movement of the each conductor 55A, 55B, 55C, 55D away from a ground plane that is within the substrate 51 may cause a rise in impedance. This impedance discontinuity may be better tuned by molding the shielding structure 59 such that the shielding structure 59 is closer to the exposed first section 64A, 64B of each conductor 55A, 55B, 55C, 55D.

Once the each conductor 55A, 55B, 55C, 55D stops angling away from the ground plane, each conductor 55A, 55B, 55C, 55D becomes flat (i.e., parallel to the substrate 51). This flattening of each conductor 55A, 55B, 55C, 55D coincides with each conductor 55A, 55B, 55C, 55D being covered with a respective insulator 56A, 56B. The cover 60 of the shielding structure 59 also becomes flat in order to be close to the insulators 56A, 56B.

At the furthest right of cable connector 50 shown in FIG. 15, the shielding structure 59 widens out. The shielding structure 59 widens out in order accommodate soldering the ground shields 57 of each twin transmitting axial cable 54A, 54B and each twin receiving axial cable 54C, 54D to the ground pad 53 of the substrate 51.

The shielding structure 59 may be manufactured by molding in order to fabricate such a variable shape wall structure. As an example, the shielding structure 59 may be molded out of plastic (e.g., conductive liquid crystal polymer, hereafter LCP) and then metal-plating on some (or all) of the shielding structure 59 surfaces. As another example, the shielding structure 59 may be machined and/or die-cast and made out of metal.

Figure 16:
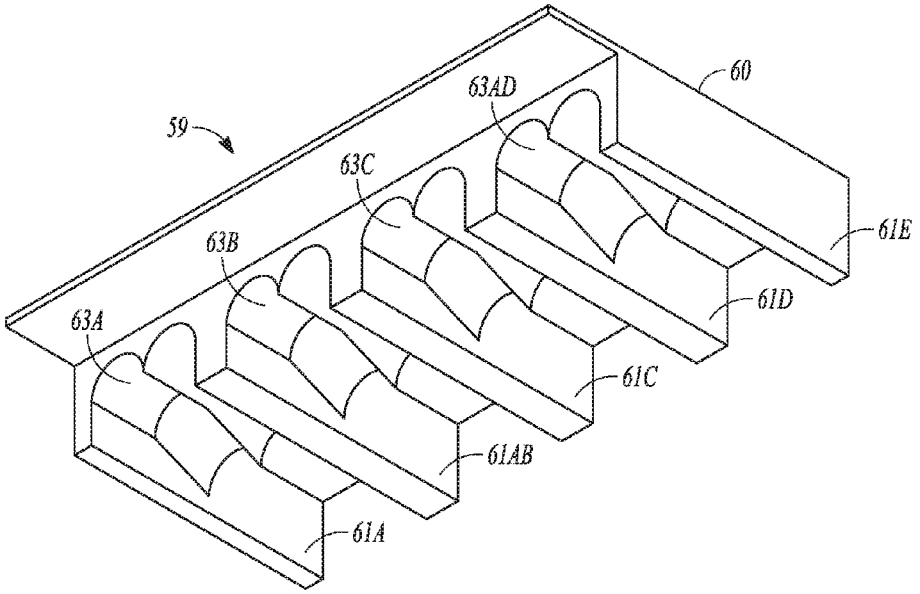
FIG. 16 shows a perspective view of an alternative shielding structure that may be used in the example cable connector illustrated in FIGS. 12 and 13.
Figure 17:
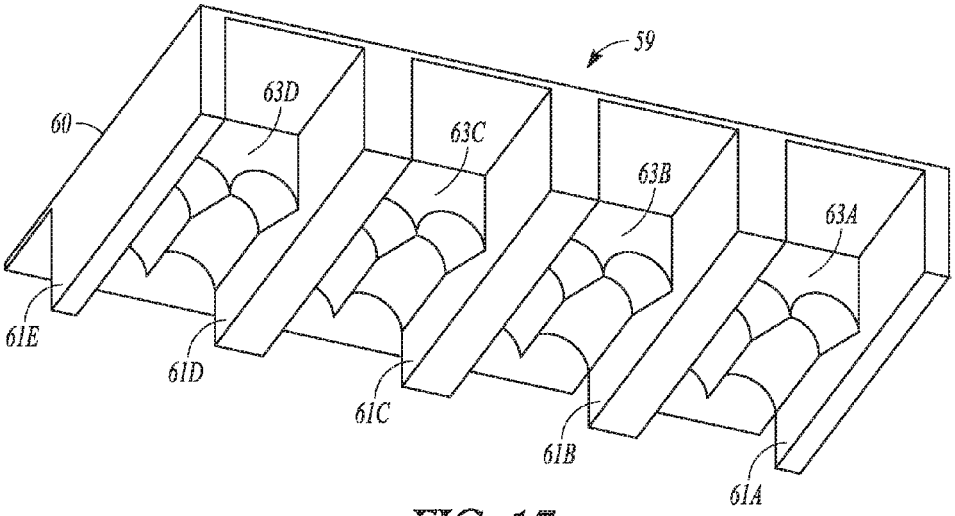
FIG. 17 shows a different perspective view of the alternative shielding structure illustrated in FIG. 16.
Figure 18:
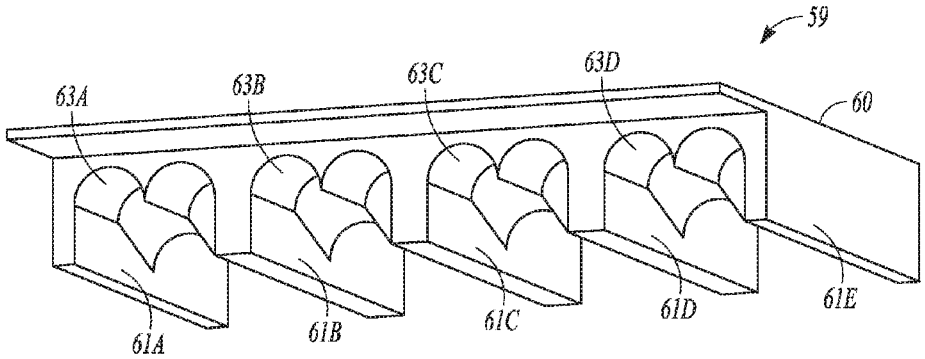
FIG. 18 shows a different perspective view of the alternative shielding structure illustrated in FIGS. 16 and 17.

FIGS. 16-18 show different perspective views of an alternative shielding structure 59 that may be used in the example cable connector 50 illustrated in FIGS. 12-15. In the example form of the shielding structure 59 shown in FIGS. 16-18, the plurality of sidewalls in the shielding structure includes inner sidewalls 61B, 61C, 61D and outer sidewalls 61A, 61E. The inner sidewalls 61B, 61C, 61D are thicker than the outer sidewalls 61A, 61E. The relative size and configuration of the inner sidewalls 61B, 61C, 61D and the outer sidewalls 61A, 61E that are included in the cable connector 50 will depend in part on the overall desired configuration and function of the cable connector 50.

In the example form of the shielding structure 59 shown in FIGS. 16-18, the cap 60 is longer than the plurality of sidewalls 61A, 61B, 61C, 61D, 61E extending from the cap 60. The cap 60 may extend over each of the twin transmitting and receiving axial cables 54A, 54B, 54C, 54D (not shown in FIGS. 16-18) in order to help ensure adequate electrically conductivity to the grounding shield of each transmitting and receiving axial cable 54A, 54B, 54C, 54D.

To better illustrate the cable connector and apparatuses disclosed herein, a non-limiting list of embodiments is provided here:

Example 1 includes a cable connector. The cable connector includes a substrate that includes a plurality of conductive pads and at least one grounding pad; a transmitting cable that includes a conductor, an insulator surrounding the conductor and a ground shield surrounding the insulator, wherein the conductor is electrically connected to one of the conductive pads and the grounding shield is electrically connected to the grounding pad; a receiving cable that includes a conductor, an insulator surrounding the conductor and a ground shield surrounding the insulator, wherein the conductor is electrically connected to one of the conductive pads and the grounding shield is electrically connected to the grounding pad; and a shielding structure that is mounted to the substrate and is electrically connected to the grounding pad, wherein the shielding structure includes a cap and a plurality of sidewalls extending from the cap to the substrate, wherein each of the transmitting and receiving cables is positioned between a different pair of side walls.

Example 2 includes the cable connector of claim 1, wherein the insulators of the transmitting and receiving cables each include a section that is partially exposed from the respective grounding shields, and wherein the shielding structure includes a pair of tunnel-shaped covers, wherein each tunnel-shaped cover extends between a different pair of side walls and covers the exposed section of a different one of the insulators.

Example 3 includes the cable connector of any one of examples 1-2, wherein the conductors of the transmitting and receiving cables each include a first portion and a second portion that are each partially exposed from the respective insulators, and wherein the tunnel-shaped cover of the shielding structure covers the exposed first portion of each conductor without covering the exposed second portion of each conductor.

Example 4 includes the cable connector of any one of examples 1-3, wherein the exposed second portion of each conductor is electrically connected to a different one of the conductive pads.

Example 5 includes a cable connector of examples 2-4 wherein the support structure is formed of plastic and each tunnel-shaped cover is covered with an electrically conductive material.

Example 6 includes the cable connector of examples 1-5, wherein the support structure is formed of plastic and covered with an electrically conductive material.

Example 7 includes a cable connector. The cable connector includes a substrate that includes a plurality of conductive pads and at least one grounding pad; a twin axial cable that includes: a first conductor; a second conductor; a first insulator surrounding the first conductor; a second insulator surrounding the second conductor; a ground shield surrounding the first and second insulators; and an outer jacket surrounding the ground shield; wherein the first and second conductors are each electrically connected to a different one of the conductive pads and the grounding shield is electrically connected to the grounding pad; and a shielding structure that is mounted to the substrate and electrically connected to the grounding pad, wherein the shielding structure includes a cap and a plurality of sidewalls extending from the cap to the substrate, wherein the twin axial cable is positioned between the sidewalls.

Example 8 includes the cable connector of example 7, wherein the first and second insulators each include a section that is partially exposed from the grounding shield, and wherein the shielding structure includes a cover that extends between the two side walls, wherein the cover includes a first tunnel-shaped segment that covers the exposed section of the first insulator and a second tunnel-shaped segment that covers the exposed section of the second insulator.

Example 9 includes the cable connector of any one of examples 7-8, wherein the first and second conductors each include a first portion and a second portion that is partially exposed from each of the first and second insulators, and wherein the first tunnel-shaped segment covers the exposed first portion of the first conductor without covering the exposed second portion of the first conductor and the second tunnel-shaped segment covers the exposed first portion of the second conductor without covering the exposed second portion of the second conductor.

Example 10 includes the cable connector of any one of examples 7-9, wherein the first tunnel-shaped segment includes a horizontal piece that covers the first insulator and an angled piece that covers the exposed first portion of the first conductor, and wherein the second tunnel-shaped segment includes a horizontal piece that covers the second insulator and an angled piece that covers the exposed first portion of the second conductor.

Example 11 includes the cable connector of any one of examples 7-10, wherein the second portion of each of the first conductor and the second conductor is electrically connected to a different one of the conductive pads.

Example 12 includes the cable connector of examples 9-11, wherein the support structure is formed of plastic and the first and second tunnel-shaped segments are covered with an electrically conductive material.

Example 13 includes cable connector of any one of examples 7-12, wherein the shielding structure is formed of plastic and covered with an electrically conductive material.

Example 14 includes a cable connector that includes a substrate that includes a plurality of conductive pads and at least one grounding pad; a plurality of twin transmitting axial cables, wherein each twin transmitting axial cable includes: a first transmitting conductor; a second transmitting conductor; a first transmitting insulator surrounding the first transmitting conductor; a second transmitting insulator surrounding the second transmitting conductor; a ground shield surrounding the first transmitting insulator and the second transmitting insulator; an outer jacket surrounding the ground shield; and wherein the first and second transmitting conductors of each twin transmitting axial cable are electrically connected to a different one of the conductive pads and the grounding shield of each transmitting twin axial cable is electrically connected to the grounding pad; a plurality of twin receiving axial cables, wherein each twin receiving axial cable includes: a first receiving conductor; a second receiving conductor; a first receiving insulator surrounding the first receiving conductor; a second receiving insulator surrounding the second receiving conductor; a ground shield surrounding the first receiving insulator and the second receiving insulator; an outer jacket surrounding the ground shield; and wherein the first and second receiving conductors of each twin receiving axial cable are electrically connected to a different one of the conductive pads and the grounding shield of each twin receiving axial cable is electrically connected to the grounding pad; and a shielding structure that is mounted to the substrate and electrically connected to the grounding pad, wherein the shielding structure includes a cap and a plurality of sidewalls extending from the cap to the substrate, wherein each twin transmitting axial cable and each twin receiving axial cable are positioned between a different pair of sidewalls.

Example 15 includes the cable connector of any one of example 14, wherein the first and second insulator of each twin transmitting axial cable and each twin receiving axial cable includes a section that is partially exposed from the grounding shield of each respective twin transmitting and receiving axial cable, and wherein the shielding structure includes a plurality of covers, wherein each cover extends between a different pair of side walls and covers the respective exposed sections of each first insulator and each second insulator for a different one of the twin transmitting and receiving axial cables.

Example 16 includes the cable connector of any one of examples 14-15, wherein each cover includes a first tunnel-shaped segment that covers the respective exposed section of a corresponding first transmitting or receiving insulator and a second tunnel-shaped segment that covers the respective exposed section of a corresponding second transmitting or receiving insulator.

Example 17 includes the cable connector of any one of examples 14-16, wherein the first and second conductors of each twin transmitting and receiving axial cable include a first portion and a second portion that are each partially exposed from each corresponding first and second transmitting or receiving insulator, and wherein each first tunnel-shaped segment covers the exposed first portion of a respective first transmitting or first receiving conductor without covering the exposed second portion of the respective first transmitting or first receiving conductor, and the second tunnel-shaped segment covers the exposed first portion of a respective second transmitting or second receiving conductor without covering the exposed second portion of the respective second transmitting or second receiving conductor.

Example 18 includes the cable connector of any one of examples 14-17, wherein each first tunnel-shaped segment includes a horizontal piece that covers a respective first transmitting or first receiving insulator and an angled piece that covers the exposed first portion of the first transmitting or first receiving conductor, and wherein each second tunnel-shaped segment includes a horizontal piece that covers a respective second transmitting or second receiving insulator and an angled piece that covers the exposed first portion of the respective second transmitting or second receiving conductor.

Example 19 includes the cable connector of any one of examples 15-18, wherein the first and second transmitting conductors and the first and second receiving conductors in each respective twin transmitting or receiving axial cable are electrically connected to a different one of the conductive pads.

Example 20 includes the cable connector of any one of examples 14-19, wherein the shielding structure is formed of plastic and each cover is covered with an electrically conductive material.

Example 20 includes the cable connector of any one of examples 14-19, wherein the shielding structure is formed of plastic and each cover is covered with an electrically conductive material.

Example 21 includes the cable connector of any one of examples 14-20, wherein the shielding structure is formed of plastic and covered with an electrically conductive material.

Example 22 includes the cable connector of any one of examples 14-21, wherein the shielding structure is soldered to the ground pad to electrically connect the shielding structure to the substrate.

Example 23 includes the cable connector of any one of examples 14-22, wherein the plurality of sidewalls in the shielding structure includes inner sidewalls and outer sidewalls, wherein the inner sidewalls are thicker than the outer sidewalls.

Example 24 includes the cable connector of any one of examples 14-23, wherein the cap is longer than the plurality of sidewalls extending from the cap.

Example 25 includes the cable connector of any one of examples 14-24, wherein each twin transmitting axial cable is adjacent to at least one twin receiving axial cable and each twin receiving axial cable is adjacent to at least twin transmitting axial cable.

These and other examples and features of the present electronic device, solder compositions, and related methods will be set forth in part in the detailed description. This overview is intended to provide non-limiting examples of the present subject matter—it is not intended to provide an exclusive or exhaustive explanation. The detailed description is included to provide further information about the systems, and methods.

Figure 19:
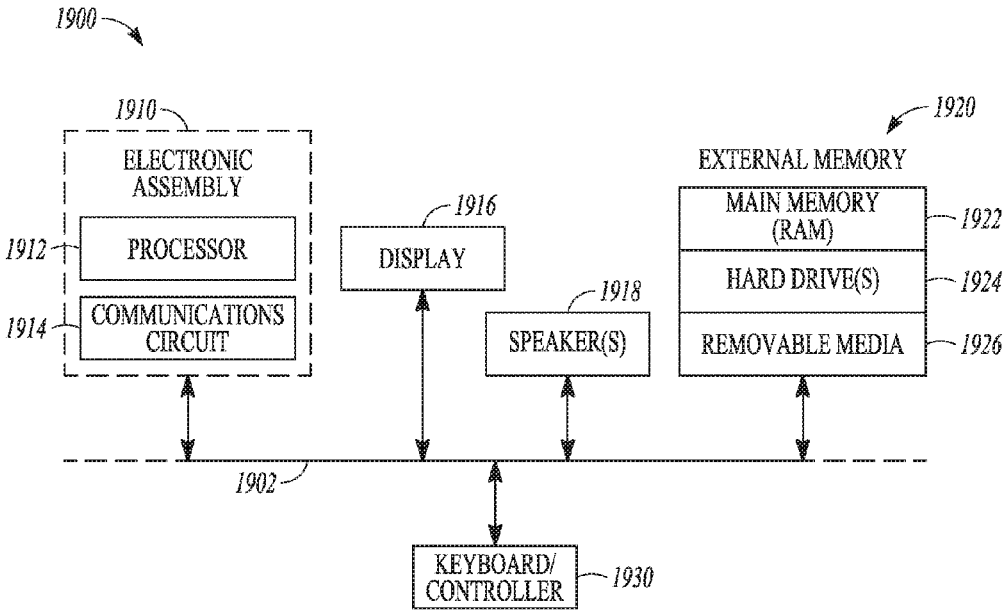
FIG. 19 is a block diagram of an electronic device incorporating at least one cable connector.

An example of an electronic device 1900 using the cable connectors that are described herein is included to show an example of a higher level device application for the present invention. FIG. 19 is a block diagram of an electronic device 1900 incorporating at least one cable connector described herein. Electronic device 1900 is merely one example of an electronic system in which embodiments of the present invention may be used.

Examples of electronic devices 1900 include, but are not limited to personal computers, tablet computers, mobile telephones, game devices, MP3 or other digital music players, etc. In this example, electronic device 1900 comprises a data processing system that includes a system bus 1902 to couple the various components of the system. System bus 1902 provides communications links among the various components of the electronic device 1900 and can be implemented as a single bus, as a combination of busses, or in any other suitable manner.

An electronic package 1910 is coupled to system bus 1902. The electronic package 1910 can include any circuit or combination of circuits. In one embodiment, the electronic package 1910 includes a processor 1912 which can be of any type. As used herein, "processor" means any type of computational circuit, such as but not limited to a microprocessor, a microcontroller, a complex instruction set computing (CISC) microprocessor, a reduced instruction set computing (RISC) microprocessor, a very long instruction word (VLIW) microprocessor, a graphics processor, a digital signal processor (DSP), multiple core processor, or any other type of processor or processing circuit.

Other types of circuits that can be included in electronic package 1910 are a custom circuit, an application-specific integrated circuit (ASIC), or the like, such as, for example, one or more circuits (such as a communications circuit 1914) for use in wireless devices like mobile telephones, tablet computers, laptop computers, two-way radios, and similar electronic systems. The IC can perform any other type of function.

The electronic device 1900 can also include an external memory 1920, which in turn can include one or more memory elements suitable to the particular application, such as a main memory 1922 in the form of random access memory (RAM), one or more hard drives 1924, and/or one or more drives that handle removable media 1926 such as compact disks (CD), flash memory cards, digital video disk (DVD), and the like.

The electronic device 1900 can also include a display device 1919, one or more speakers 1918, and a keyboard and/or controller 1930, which can include a mouse, trackball, touch screen, voice-recognition device, or any other device that permits a system user to input information into and receive information from the electronic device 1900.

This overview is intended to provide non-limiting examples of the present subject matter—it is not intended to provide an exclusive or exhaustive explanation. The detailed description is included to provide further information about the methods.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description.

The Abstract is provided to comply with 37 C.F.R. §1.72(b), to allow the reader to quickly ascertain the nature of the technical disclosure. It is submitted with the understanding that it will not be used to interpret or limit the scope or meaning of the claims.

Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A cable connector comprising:

a substrate that includes a plurality of conductive pads and at least one grounding pad;

a transmitting cable that includes a conductor, an insulator surrounding the conductor and a ground shield surrounding the insulator, wherein the conductor is electrically connected to one of the conductive pads and the grounding shield is electrically connected to the grounding pad;

a receiving cable that includes a conductor, an insulator surrounding the conductor and a ground shield surrounding the insulator, wherein the conductor is electrically connected to one of the conductive pads and the grounding shield is electrically connected to the grounding pad; and a shielding structure that is mounted to the substrate and is electrically connected to the grounding pad, wherein the shielding structure includes a cap and a plurality of sidewalls extending from the cap to the substrate, wherein each of the transmitting and receiving cables is positioned between a different pair of side walls, wherein the insulators of the transmitting and receiving cables each include a section that is partially exposed from the respective grounding shields, and wherein the shielding structure includes a pair of tunnel-shaped covers, wherein each tunnel-shaped cover extends between a different pair of side walls and covers the exposed section of a different one of the insulators, wherein the conductors of the transmitting and receiving cables each include a first portion and a second portion that are each partially exposed from the respective insulators, and wherein the tunnel-shaped cover of the shielding structure covers the exposed first portion of each conductor without covering the exposed second portion of each conductor.

2. The cable connector of claim 1, wherein the exposed second portion of each conductor is electrically connected to a different one of the conductive pads.

3. The cable connector of claim 1, wherein the shielding structure is formed of plastic and each tunnel-shaped cover is covered with an electrically conductive material.

4. The cable connector of claim 1, wherein the shielding structure is formed of plastic and covered with an electrically conductive material.

5. A cable connector comprising:

a substrate that includes a plurality of conductive pads and at least one grounding pad;

a twin axial cable that includes:

a first conductor;

a second conductor;

a first insulator surrounding the first conductor;

a second insulator surrounding the second conductor;

a ground shield surrounding the first and second insulators; and an outer jacket surrounding the ground shield; and a shielding structure that is mounted to the substrate and electrically connected to the grounding pad, wherein the shielding structure includes a cap and a plurality of sidewalls extending from the cap to the substrate, wherein the twin axial cable is positioned between the sidewalls, wherein the first and second insulators each include a section that is partially exposed from the grounding shield, and wherein the shielding structure includes a cover that extends between the two side walls, wherein the cover includes a first tunnel-shaped segment that covers the exposed section of the first insulator and a second tunnel-shaped segment that covers the exposed section of the second insulator, wherein the first and second conductors each include a first portion and a second portion that is partially exposed from each of the first and second insulators and wherein the first tunnel-shaped segment covers the exposed first portion of the first conductor without covering the exposed second portion of the first conductor and the second tunnel-shaped segment covers the exposed first portion of the second conductor without covering the exposed second portion of the second conductor.

6. The cable connector of claim 5, wherein the first tunnel-shaped segment includes a horizontal piece that covers the first insulator and an angled piece that covers the exposed first portion of the first conductor, and wherein the second tunnel-shaped segment includes a horizontal piece that covers the second insulator and an angled piece that covers the exposed first portion of the second conductor.

7. The cable connector of claim 6, wherein the second portion of each of the first conductor and the second conductor is electrically connected to a different one of the conductive pads.

8. The cable connector of claim 5, wherein the shielding structure is formed of plastic and the first and second tunnel-shaped segments are covered with an electrically conductive material.

9. The cable connector of claim 5, wherein the shielding structure is formed of plastic and covered with an electrically conductive material.

10. A cable connector comprising:

a substrate that includes a plurality of conductive pads and at least one grounding pad;

a plurality of twin transmitting axial cables, wherein each twin transmitting axial cable includes:

a first transmitting conductor;

a second transmitting conductor;

a first transmitting insulator surrounding the first transmitting conductor;

a second transmitting insulator surrounding the second transmitting conductor;

a ground shield surrounding the first transmitting insulator and the second transmitting insulator;

an outer jacket surrounding the ground shield; and wherein the first and second transmitting conductors of each twin transmitting axial cable are electrically connected to a different one of the conductive pads and the grounding shield of each transmitting twin axial cable is electrically connected to the grounding pad;

a plurality of twin receiving axial cables, wherein each twin receiving axial cable includes:

a first receiving conductor;

a second receiving conductor;

a first receiving insulator surrounding the first receiving conductor;

a second receiving insulator surrounding the second receiving conductor;

a ground shield surrounding the first receiving insulator and the second receiving insulator;

an outer jacket surrounding the ground shield; and wherein the first and second receiving conductors of each twin receiving axial cable are electrically connected to a different one of the conductive pads and the grounding shield of each twin receiving axial cable is electrically connected to the grounding pad; and a shielding structure that is mounted to the substrate and electrically connected to the grounding pad, wherein the shielding structure includes a cap and a plurality of sidewalk extending from the cap to the substrate, wherein each twin transmitting axial cable and each twin receiving axial cable are positioned between a different pair of sidewalls, wherein the first and second insulator of each twin transmitting axial cable and each twin receiving axial cable includes a section that is partially exposed from the grounding shield of each respective twin transmitting and receiving axial cable, and wherein the shielding structure includes a plurality of covers, wherein each of the covers extends between a different pair of side walls and covers the respective exposed sections of each first insulator and each second insulator, wherein each of the covers includes a first tunnel-shaped segment that covers the exposed section of a corresponding first transmitting or receiving insulator and a second tunnel-shaped segment that covers the exposed section of a corresponding second transmitting or receiving insulator, wherein the first and second conductors of each twin transmitting and receiving axial cable include a first portion and a second portion that are each partially exposed from each corresponding first and second transmitting or receiving insulator, and wherein each first tunnel-shaped segment covers the exposed first portion of a respective first transmitting or first receiving conductor without covering the exposed second portion of the respective first transmitting or first receiving conductor, and the second tunnel-shaped segment covers the exposed first portion of a respective second transmitting or second receiving conductor without covering the exposed second portion of the respective second transmitting or second receiving conductor.

11. The cable connector of claim 10, wherein each first tunnel-shaped segment includes a horizontal piece that covers a respective first transmitting or first receiving insulator and an angled piece that covers the exposed first portion of the first transmitting or first receiving conductor, and wherein each second tunnel-shaped segment includes a horizontal piece that covers a respective second transmitting or second receiving insulator and an angled piece that covers the exposed first portion of the respective second transmitting or second receiving conductor.

12. The cable connector of claim 10, wherein the first and second transmitting conductors and the first and second receiving conductors in each respective twin transmitting or receiving axial cable are electrically connected to a different one of the conductive pads.

13. The cable connector of claim 10, wherein the shielding structure is formed of plastic and the cover is covered with an electrically conductive material.

14. The cable connector of claim 10, wherein the shielding structure is formed of plastic and covered with an electrically conductive material.

15. The cable connector of claim 10, wherein the shielding structure is soldered to the ground pad to electrically connect the shielding structure to the substrate.

16. The cable connector of claim 10, wherein the plurality of sidewalls in the shielding structure includes inner sidewalls and outer sidewalls, wherein the inner sidewalls are thicker than the outer sidewalls.

17. The cable connector of claim 10, wherein the cap is longer than the plurality of sidewalls extending from the cap.

18. The cable connector of claim 10, wherein each twin transmitting axial cable is adjacent to at least one twin receiving axial cable and each twin receiving axial cable is adjacent to at least twin transmitting axial cable.

* * * * *